United States Patent [19]

Stumpf

[11] 4,322,993

[45] Apr. 6, 1982

[54] ARRANGEMENT IN A CUTTING APPARATUS FOR ENGAGING AND RETAINING A WEB-LIKE MATERIAL, PARTICULARLY SUPERPOSED MATERIAL WEBS

[76] Inventor: Günter O. Stumpf, Höhenweg 13, 7421 Mehrstetten, Kr. Münsingen, Fed. Rep. of Germany

[21] Appl. No.: 127,847

[22] Filed: Mar. 6, 1980

[30] Foreign Application Priority Data

Mar. 6, 1979 [DE] Fed. Rep. of Germany ..... 2908701

[51] Int. Cl.[3] ..... D06H 7/24

[52] U.S. Cl. ..... 83/422; 83/451; 83/925 CC; 198/689

[58] Field of Search ..... 83/422, 925 CC, 451; 198/689, 811

[56] References Cited

U.S. PATENT DOCUMENTS

| | | | |
|---|---|---|---|
| 3,598,006 | 8/1971 | Gerber | 83/925 CC |
| 3,815,221 | 6/1974 | Pearl | 83/925 CC |
| 3,835,747 | 9/1974 | Bystron | 83/925 CC |

*Primary Examiner*—James M. Meister

*Attorney, Agent, or Firm*—Scully, Scott, Murphy & Presser

[57] ABSTRACT

Arrangement for engaging and retaining web-like material, more particularly a plurality superposed webs of cloth for a cutting-out machine or cloth pattern cutter, including a device for generating a vacuum below a bristle belt conveying the material.

11 Claims, 4 Drawing Figures

ARRANGEMENT IN A CUTTING APPARATUS FOR ENGAGING AND RETAINING A WEB-LIKE MATERIAL, PARTICULARLY SUPERPOSED MATERIAL WEBS

BACKGROUND OF THE INVENTION

1. Field of the Invention

The present invention relates to an arrangement for engaging and retaining a web-like material, in particular a plurality of superposed webs of cloth, the uppermost cloth web of which is covered by a foil of at least substantial air-impermeability for a cutting out machine or cloth cutter which may be positioned intermediate a material infeed table and a material take-off device, including an endless bristle belt which is movable in the material-conveying direction of the cloth cutter, and between the bristles of which there may be exerted a suction pressure on the web material.

2. Discussion of the Prior Art

It is already known in connection with an arrangement for the automatic cutting of flat material webs to provide bristle mats which are positioned behind each other in the material-conveying direction, in the region of their longitudinal edges extending in the material-conveying direction these mats being subjected to a suction pressure or vacuum which thereby acts intermediate the bristles of the bristle mats against the superposed material. In essence, this signifies that the material lying on the respective bristle mat is clamped at its end regions extending parallel to the aforementioned material-conveying direction through the therein presently effective suction pressure. However, it is disadvantageous in that there must be exerted relatively high tensile forces on the material in order to be able to at all pull this material over the bristle mats in the aforementioned conveying direction. It is also disadvantageous that the generation of the vacuum or suction pressure along the longitudinal edges of the bristle mats extending in the material-conveying direction does not ensure that the material to be cut will remain flat on the bristle mats when the cutting device provided performs the cutting actions in the mentioned conveying direction. In this instance, this may lead to a bunching up of the material in the pertinent direction of movement.

Furthermore, it is also known to provide an endless bristle belt on which the material which is presently to be cut be employed in connection with a device for cutting a web-like material. However, this bristle belt has an air-permeable bristle support which, within the zone of material conveyance, is guided over a porous support plate, and which is so connected with a vacuum generator as to generate a suction effect through the air-permeable bristle support against the web-like material supported on the bristles thereof. Although in most instances web-like materials can be satisfactorily engaged and retained with the assistance of this type of bristle belt and, moreover, there are overcome the difficulties which are expected in connection with the heretofore considered known arrangement; however, in a few instances it may prove to be disruptive that the applicable bristle band has a relatively low number of bristles. With regard to bristle mats of the type employed as in the case of the previously considered arrangement, an air-permeable bristle belt has already less bristles based on the fact of its air permeability alone. The air permeability of the bristle support of the bristle belt is usually achieved in that the bristle support is perforated. However, no bristles can be present at the locations provided for the perforations. This may exert a disadvantageous effect during the engagement and retention of extremely thin webs of cloth.

SUMMARY OF THE INVENTION

Accordingly, it is an object of the present invention to provide in an arrangement of the above-mentioned type, a device which ensures that web-like material is engaged and retained in a reliable manner even when this material is in the form of relatively thin superposed webs of cloth, while avoiding the disadvantages encountered with the prior art arrangement.

It is a more specific object of the present invention to improve upon an arrangement of the above-mentioned type by causing the suction pressure or vacuum to become effective in the region of the deflection points of the bristle belt extending transversely to the material conveying direction only intermediate its bristles through to the upper surface of the bristle belt.

The advantage of this construction is that it becomes possible, in a particularly simple manner, for the respective web-like material to be reliably engaged and retained, it also being possible for the bristles to be arranged substantially denser on the presently contemplated bristle belt than on a bristle belt of the prior art arrangement. However, this signifies that there is afforded the advantage that particularly thin, superposed webs of cloth can be grasped or engaged by the bristle belt without these thin webs of cloth being aspirated into the regions between the bristles of the bristle belt. It is precisely because the vacuum or suction pressure becomes effective in areas which extend transversely to the material conveying direction, that there is ensured a particularly reliable clamping of the web-like material in question in the conveying direction, thereby avoiding any gathering together of this material during the effectuation of cutting operations in the material conveying direction. It is also advantageous that, according to the invention, it is also easy to engage and retain web material which is shorter in its conveying direction than the bristle belt, in which instance there is maintained the possibility of easily conveying this material while concurrently reliably engaging and retaining the material on the bristle belt.

Advantageously, the bristle belt which is conducted about two spaced rollers is enclosed by a container which leaves free the upper surface of the bristle belt for engaging and retaining the web-type material, this container being sealed along its longitudinal sides and connected in the region of the two rollers with a vacuum generator. This provides the advantage of a particularly stable construction which is particularly effective in imparting vacuum or suction pressure to the bristle belt.

Oppositely located sealing strips are suitably provided along the longitudinal sides of the bristle belt extending parallel to the bristle belt conveying direction so as to project above its longitudinal edges. This provides the advantage of a particularly simple and effective sealing for the container in the bristle belt conveying device along the longitudinal sides of the bristle belt.

Preferably, a plate is positioned on the underside in the region of the bristle belt which is adapted for the engagement and retaining of the web material, so that there is formed a space which, as occasioned, is subjected to the vacuum generated by the vacuum generator, the space being between the rollers below the respective plate. This measure also provides the advantage that there is encountered practically no loss in suction pressure or vacuum below the above-mentioned plate, which signifies that the respective suction pressure is practically completely effective on the upper surface of the bristle belt in order to retain the web-like material on this upper surface.

The vacuum generator is preferably connected with air-permeable wall regions of the container which are located below the centers of the rollers. This provides the advantage of a particularly simple constructive connection of the vacuum generator with the mentioned container wherein, additionally, there is maintained the high effectiveness of the vacuum on the upper side of the bristle belt.

Suitably, the container is provided at its longitudinal sides which extend in parallel with the bristle belt conveying direction with sealing arrangements producing an enhanced sealing effect when a vacuum is present within the container. This produces the advantage of a particularly effective sealing of the container along its longitudinal sides.

The sealing arrangements are preferably formed by elastic sealing elements which abut against the installation elements. This will afford the advantage of a particularly effective seal.

Preferably, the longitudinal edges of the bristle belt are used as support elements, and the sealing elements are fastened to the container or to the sealing strips. The advantage of this lies in the particularly low constructional demands.

On the other hand, when separate angle pieces are utilized as support elements and attached to the longitudinal edges of the bristle belt and the sealing elements are fastened to, respectively, the container or to the sealing strips, the obtained advantage is a secure sealing of the container. The pertinent angle pieces themselves are constituted from an elastic material in order to ensure the desired sealing effect.

BRIEF DESCRIPTION OF THE DRAWINGS

Reference is now had in detail to the following exemplary embodiments of the invention, taken in conjunction with the accompanying drawings; in which.

DETAILED DESCRIPTION

Figure 1:
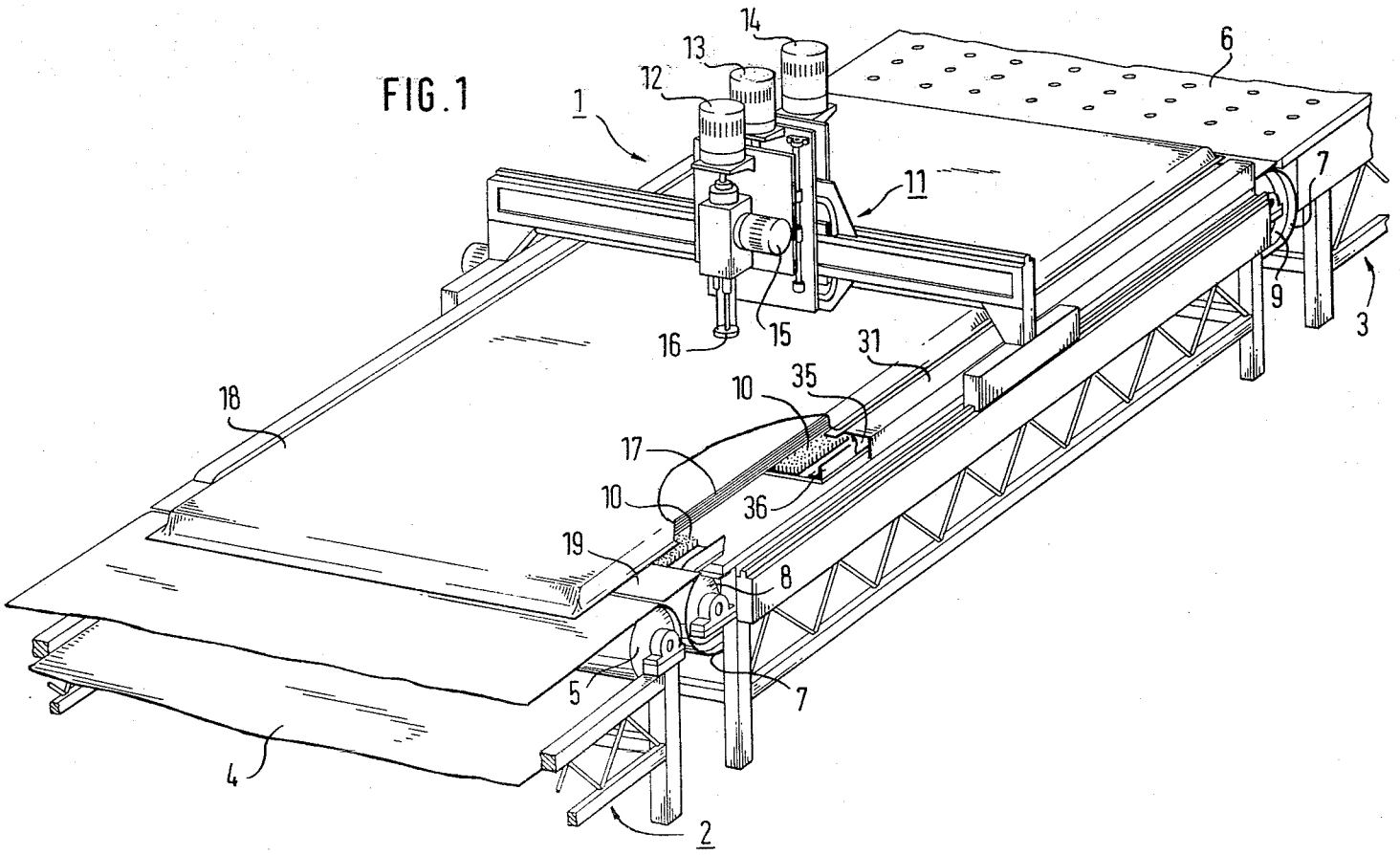
FIG. 1 shows a perspective view of a cutting out machine or cloth pattern cutter incorporating a device according to the invention.

FIG. 1 illustrates a cutting out machine or cloth pattern cutter 1 which serves for cutting web-like material consisting of several superposed webs of cloth 17, the uppermost web of cloth being covered by a foil 18 which is at least substantially impermeable to air. The web-like material formed by the webs of cloth 17 with the superposed foil 18 is shown in FIG. 1 as exiting from a material feed table 2 to the cutting out machine 1. For this purpose, the material feed table 2 comprises a conveyor belt 4. A material take-off device 3, comprising a material receiving table with a receiving plate 6, is arranged behind the cutting out machine 1 in the direction of conveyance of the web-like material 17. The cutting out machine 1 is thus arranged intermediate the material feed table 2 and the material take-off device 3.

Figure 3:
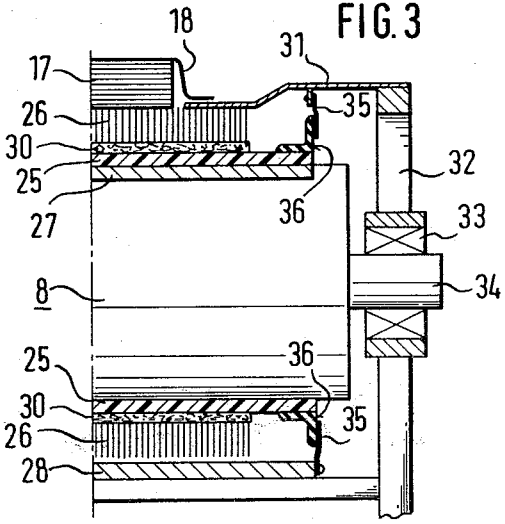
FIG. 3 shows an enlarged sectional view of a sealing end region of one of the rollers designed for the apparatus according to FIG. 2, taken along the line A—A in FIG. 2.

The web-like material 17 which is formed by several superposed webs of cloth is engaged, together with the foil 18 supported on the top web of cloth, by a bristle belt 10 which is passed about two rollers 8, 9 extending transversely of the material-conveying direction. The two rollers 8 and 9 are located within an upwardly opening container 7. FIG. 1 also illustrates that a carrier plate 19 projects from the container 7 and ends approximately at the conveyor belt 4 of the material feed table 2. The container 7 is sealed along its longitudinal sides through the intermediary of sealing devices, respective which angle pieces 36 are attached along the longitudinal edges of the bristle belt 10 and, abutting these, are associated sealing elements 35 which are practically fastened to the container and, more precisely, to sealing strips 31 which extend in parallel with the bristle belt conveying direction along the longitudinal sides of the container 7. The precise relationships of the sealing of the container 7 in the manner explained herein above are shown in FIG. 3.

The cutting out machine 1 illustrated in FIG. 1 includes a cutting out device 11 which is provided with electromotors 12, 13, 14 and 15 enabling it to impart movements in various directions to a cutting blade or knife 16. The electromotor 12 also serves to rotate the cutting blade 16 about its own longitudinal axis. The electromotor 13 serves to displace the cutting blade 16 in its longitudinal direction. The electromotor 14 serves to displace the entire cutting arrangement 11 in the longitudinal direction of a supporting arm extending transversely to the material conveying direction which itself is displaceable by another electromotor (not shown) in the respective material conveying direction. The motor 15 imparts lifting movements to the cutting blade 16.

Figure 2:
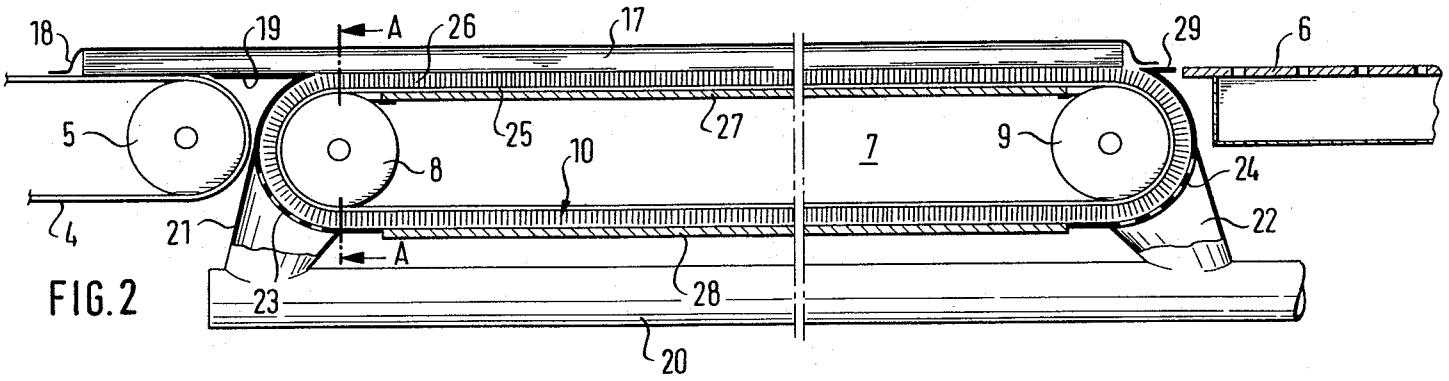
FIG. 2 schematically illustrates a sectional view of a device according to the invention, as used in the machine of FIG. 1.

FIG. 2 schematically shows in greater detail a section through the apparatus used with the cutting out machine of FIG. 1 for engaging and retaining the web-like material 17 with the superposed foil 18. It is apparent that the bristle belt 10 is passed around the two spaced rollers 8 and 9. Also shown is the container 7 illustrated in FIG. 1 which, to a certain extent, substantially encloses the bristle belt 10 and leaves the belt free only in the region of the upper side of the bristle belt. According to FIG. 2, the container 7 has container regions enclosing the rollers 8 and 9 or the bristle belt regions passed about the latter, and with the container regions including respective air-permeable wall portions 23 or 24 below the centers of the rollers 8, 9. Suction pipes 21 or 22 which are, in turn, connected with a common pipe 20 are connected with these air-permeable wall portions 23, 24. The pipe 20 is connected to a vacuum generator (not shown). The above-mentioned wall portion 23, 24 are joined to each other along the underside of the apparatus represented in FIG. 2 by a base wall 28.

Two support plates 19 and 29, of which plate 19 is already illustrated in FIG. 1, are connected with the container 7 shown in FIG. 2. This support plate 19 extends in alignment with the top of the conveyor belt 4 which passes around a roller 5 of the above-mentioned material infeed table. The other previously mentioned support plate 2 is connected with the container 7 in the region of the roller 9 so as to be aligned with the receiving plate 6 of a material take-off device as already shown in FIG. 1.

A plate 27 is provided intermediate the rollers 8 and 9 which are located within the container 7, and has its edges extending transversely to the moving direction of the bristle belt 10 so as to sealingly abut the upper surfaces of the rollers 8, 9. For this purpose, the plate 27 may be provided on its applicable edges with elastic sealing elements, as shown in FIG. 2. The upper surface of the plate 27 serves for, respectively, receiving and supporting the bristle support 25 of the bristle belt 10. This ensures that from the bristle support 25 the bristles 26 will be provided on the upper side of the apparatus of FIG. 2 in a defined plane between the rollers 8 and 9.

During operation, in the arrangement shown in FIG. 2, the vacuum, which is effective in the pipe 20 and in the suction pipes 21 and 22, becomes effective through the air-permeable belt regions 23 and 24 of the container 7 between those bristles 26 of the bristle belt 10 which project from the bristle support 25 above the centers of the rollers 8. Thus, the suction pressure generated between the respective bristles 26 is effective through to the upper side of the bristle belt on which there is arranged the material web 17 with the superposed foil 18. This signifies that the material web 17 is subjected along its conveying direction to suction pressures at deflection points of the bristle belt 10 extending transversely to the conveying arrangement and thus is restrained in this direction.

The suction pressure to which the air-permeable belt regions 23 and 24 of the container 7 are now subjected acts not only as previously discussed in the direction of the upper side of the bristle belt of the apparatus but also within the container 7. Within the container 7, the vacuum is effective at least in the region between the lower container plate 28 and the bristle carrier 25 in the immediate vicinity thereof. If it is assumed that this bristle carrier also has a certain degree of air-permeability, the relevant vacuum is then effective in the space between the rollers 8 and 9 below the upper plate 27.

In order to enable the above-mentioned effects to take place, the container 7 is sealed along its longitudinal sides which extend in the direction of material conveyance. In this connection, FIG. 1 already illustrates one embodiment for sealing the longitudinal sides of the container 7. The type of sealing used is shown more clearly in the sectional view of FIG. 3. FIG. 3 shows, on an enlarged scale, a partial sectional view along the section line A—A shown in FIG. 2. The roller 8 is fixed through a pivot pin 34 with a bearing retained by a supporting device 32. Abutting the periphery of the roller 8, on the one hand, is the plate 27, and on the other hand, abutting the respective roller periphery, the bristle belt with the bristle support 25, through which the bristles 26 are joined by an adhesive layer 30. Along the upper side of the arrangement shown in FIG. 3, the material layers 17 together with the foil 18 are supported on the bristles 26. The bristles 26 are also covered at their outer peripheral region by a sealing strip 31 from which there projects an elastic sealing element 35. This elastic sealing element 35 may be attached to a leg section projecting downwardly from the sealing strip 31. The elastic sealing element 35 is a sealing element extending substantially in parallel with the bristle belt. In the lower region of the container, the sealing element 35 is attached to the plate 28 provided therein. The side of the sealing element 35 which is shown on the left in FIG. 3, abuts an angle piece 36 which is attached to the upper side of the bristle support 25. The applicable angle piece 36, which is also constituted of an elastic material, together with the sealing element 35 forms a sealing device through which the container 7, as shown in greater detail in FIG. 2, is sealed along one of its longitudinal sides. Due to the gap between the sealing device and the bristles 26 of the bristle band, the suction pressure produced by the vacuum generator is effective in a manner whereby an increased sealing effect is produced by the sealing device.

A sealing arrangement which is identical to the previously discussed sealing arrangement is located on the opposite side of the bristle band not shown in FIG. 3.

Figure 4:
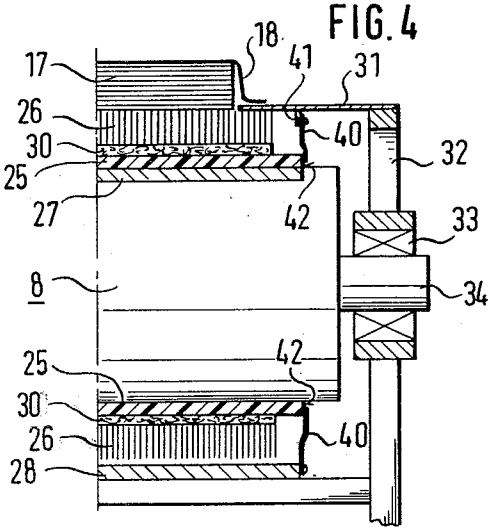
FIG. 4 shows an enlarged sectional view of a modified sealing end region of one of the rollers designed for the apparatus according to FIG. 2, taken along the line A—A in FIG. 2.

FIG. 4 illustrates a modification of the sealing arrangement shown in FIG. 3. Similar to FIG. 3, FIG. 4 shows in a corresponding sectional view along to the cutting line A—A marked in FIG. 2 and on an enlarged scale only one part of the roller 8 with the adjoining elements. Thus, FIG. 4 shows those elements which correspond with the elements shown in FIG. 3 and explained above as being provided with the same reference numerals as the corresponding elements in FIG. 3. In contrast with the arrangement according to FIG. 3, an elastic sealing element 40 is provided herein which abuts the outer edge 42 of the bristle support 25 of the bristle belt. The bristle support 25 of the bristle belt thus assumes the function of the angle piece 36 provided in the arrangement according to FIG. 3. The sealing element 40 provided in the arrangement according to FIG. 4 is also attached in a manner corresponding to that of the sealing element 35 of the arrangement in FIG. 3. As shown in the upper part of FIG. 4, it becomes evident that the sealing element 40 is attached to a leg portion 41 which projects from the sealing strip 31. In the lower part of FIG. 4 the sealing element 40 is attached to the lower plate 28 which is a component of container 7.

What is claimed is:

1. In an arrangement for engaging and retaining a web-like material, particularly a plurality of superposed webs of cloth; a substantially air-impermeable foil covering the uppermost web of cloth, said arrangement being for a cutting-out machine adapted to be positioned intermediate a material infeed table and material take-off means; an endless bristle band, having an underlying bristle support carrying projection bristles, movable in the material-conveying direction of said cutting out machine; and means, coacting with a vacuum generator, for producing a suction pressure between the bristles of said bristle band acting on said web material; characterized in that the bristle band (10), up to that portion on which the webs of cloth (17) are located, is encompassed by an encompassing wall structure (27,28,31), with the encompassing wall structure (27,28,31) being sealed by sealing means positioned laterally along the side edges of the bristle support (25) for the bristle band (10) along said material-conveying direction, and that the space defined between the encompassing wall structure (27,28,31) within which the bristle band moves is connected to a vacuum generator.

2. Arrangement as claimed in claim 1, comprising two spaced rollers, said bristle band extending about said rollers; said encompassing wall structure enclosing said rollers while leaving free the upper side of said bristle band to engage and retain said web material; and means connecting said container in the region of said two rollers with said vacuum generator.

3. Arrangement as claimed in claim 2, said sealing means comprising sealing strips along the longitudinal sides of said bristle band extending parallel to the conveying direction of said band, said sealing strips facing each other and projecting above the longitudinal edges of said bristle band.

4. Arrangement as claimed in claim 2 or 3, comprising a plate located at the underside of said bristle band in the area provided for engaging and retaining said web-like material so as to form a space below the plate between said rollers adapted to be subjected to the suction pressure generated by said vacuum generator.

5. Arrangement as claimed in claim 4, said vacuum generator being connected with air-permeable wall portions of the container, said wall portions being located below the centers of said rollers.

6. Arrangement as claimed in claim 2, said sealing means extending on the longitudinal sides of said encompassing wall structure parallel to the direction of conveyance of said bristle band, said sealing means producing an increased sealing effect in the presence of an effective vacuum within said container.

7. Arrangement as claimed in claim 6, said sealing means comprising elastic sealing elements abutting structural elements of said arrangement.

8. Arrangement as claimed in claim 7, wherein the longitudinal edges of said bristle band form bearing elements, said sealing means being fastened to the encompassing wall structure.

9. Arrangement as claimed in claim 7, wherein the longitudinal edges of said bristle band form bearing elements, said sealing means being fastened to sealing strips.

10. Arrangement as claimed in claim 7, comprising separate angle members attached as bearing elements to the longitudinal edges of said bristle band, said sealing means being fastened to said encompassing wall structure.

11. Arrangement as claimed in claim 7, comprising separate angle members attached as bearing elements to the longitudinal edges of said bristle belt, said sealing means being fastened to sealing strips.

* * * * *